United States Patent [19]

Moskowitz et al.

[11] Patent Number: 4,692,661

[45] Date of Patent: Sep. 8, 1987

[54] FLUORESCENT LAMP WITH STATIC MAGNETIC FIELD GENERATING MEANS

[75] Inventors: Philip E. Moskowitz, Peabody; Jakob Maya, Brookline, both of Mass.

[73] Assignee: GTE Products Corporation, Danvers, Mass.

[21] Appl. No.: 830,152

[22] Filed: Feb. 18, 1986

[51] Int. Cl.[4] ..... H01J 61/42; H01J 1/50

[52] U.S. Cl. ..... 313/485; 313/161; 313/493

[58] Field of Search ..... 313/485, 161, 493

[56] References Cited

U.S. PATENT DOCUMENTS

| | | | |
|---|---|---|---|
| 3,991,336 | 11/1976 | Suga | 313/161 X |
| 4,177,401 | 12/1979 | Yamane et al. | 313/161 X |
| 4,187,446 | 2/1980 | Gross et al. | 313/204 X |
| 4,311,942 | 1/1982 | Skeist et al. | 313/161 X |
| 4,311,943 | 1/1982 | Gross et al. | 313/161 X |
| 4,341,979 | 7/1982 | Gross et al. | 313/161 X |
| 4,417,172 | 11/1983 | Touhou et al. | 313/156 |
| 4,434,385 | 2/1984 | Touhou et al. | 313/161 |
| 4,514,662 | 4/1985 | Skeist et al. | 313/161 X |
| 4,549,110 | 10/1985 | Berman et al. | 313/161 X |

FOREIGN PATENT DOCUMENTS 60682 4/1985 Japan .

*Primary Examiner*—Palmer C. DeMeo

*Attorney, Agent, or Firm*—Carlo S. Bessone

[57] ABSTRACT

A fluorescent lamp wherein magnetic field generating means (e.g., permanent magnets) are utilized to generate a static magnetic field across the respective electrode structures of the lamp such that maximum field strength is located at the electrode's filament. An increase in efficacy during operation has been observed.

8 Claims, 2 Drawing Figures

FLUORESCENT LAMP WITH STATIC MAGNETIC FIELD GENERATING MEANS

The United States Government has rights to this invention pursuant to Contract No. DE-AC03-76SF00098 awarded by the United States Department of Energy.

TECHNICAL FIELD

This invention relates to electric lamps and particularly to those of the fluorescent variety.

BACKGROUND

Presently, there are several million fluorescent lamps of different types (e.g., circular, linear, etc.) being utilized throughout the United States and foreign countries. Understandably, with so many lamps of this type in operation, it is highly desirous to improve lamp efficacy (lumen output per watt) as a means of conserving energy. It has been established that even a relatively minor increase in efficacy will result in a substantial energy savings if applied to correspondingly large numbers of such lamps. By way of example, it is estimated that an increase in efficacy of only about 5 percent for each linear fluorescent lamp in use in the U.S. (approximately one billion lamps) would result in an energy savings of about $500 million/year.

The instant invention represents a viable means for providing increased efficacy for a fluorescent lamp and is thus believed to constitute a significant advancement in the art.

DISCLOSURE OF THE INVENTION

It is, therefore, a primary object of this invention to provide a fluorescent lamp having increased efficacy.

It is another object of this invention to provide a fluorescent lamp wherein efficacy is increased in a facile and inexpensive manner.

It is yet another object of this invention to provide a means for increasing fluorescent lamp efficacy which can be readily adapted to many existing fluorescent lamps currently in operation.

In accordance with one aspect of the invention, there is provided a fluorescent lamp including an elongated tubular envelope having first and second opposing end portions and including therein an atmosphere of mercury and a rare gas. Located within each of the opposing end portions is an electrode structure which includes a pair of lead wires and a filament. The lamp's efficacy is increased through utilization of first and second magnetic field generating means which each substantially surround one of the respective electrodes for applying a static magnetic field across the respective electrode such that the maximum field strength so generated is substantially located at the electrode's filament.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
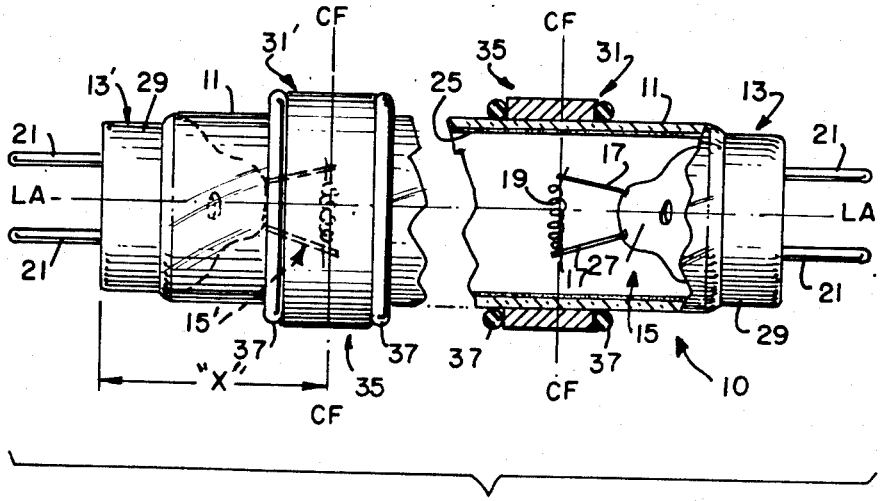
FIG. 1 is a side elevational view, partly in section, of a fluorescent lamp in accordance with a preferred embodiment of the invention.

With particular attention to FIG. 1, there is shown an improved fluorescent lamp 10 in accordance with a preferred embodiment of the invention. Lamp 10 includes an elongated tubular envelope 11 of a glass material (e.g., lime glass) known in the art. In the embodiment depicted in FIG. 1, envelope 11 is shown as being of the linear type. It is understood, however, that the teachings of the instant invention are equally applicable to lamps wherein the envelopes are of different configurations (e.g., circular). Envelope 11 is shown in FIG. 1 as including first and second opposing end portions 13 and 13' respectively. Located within each end portion (only one shown in cross section in FIG. 1) is an electrode structure 15 which in turn includes at least two lead wires 17 of a conductive material known in the art which in turn provide electrical connection and support for a coiled tungsten filament 19 secured thereto. As shown, only one electrode (15) is shown in clear, full lines in FIG. 1. The opposing electrode 15' is illustrated in hidden lines within end 13' for clarification purposes. It is understood that this second electrode 15' is substantially identical to electrode 15. The preferred conductive material for each lead of the respective electrodes is nickel. Each of these leads is in turn electrically coupled to a corresponding terminal pin 21 which projects externally from the respective end portion in the manner illustrated. As is known, each of these conductive pins is designed for being positioned within a corresponding socket or the like to in turn provide the requisite electrical connection to the power source necessary to operate lamp 10. Traditionally, lamps of the type described herein are operational utilizing standard line current (e.g., 110 VAC).

Envelope 11 includes an atmosphere therein comprised of mercury and a rare gas (e.g., argon, krypton, xenon). In addition, the interior surface of the cylindrical, elongated envelope 11 is coated with at least one layer of a suitable phosphor 25, several of which are known in the art. As also illustrated in FIG. 1, each of the electrodes is located within (and extends from) a glass stem 27 which is formed in accordance with technology known in the art. Each of the invention's electrodes 15 and 15' extend within the envelope such that filament 19 is located at a predetermined distance ("X") from the end surface of the metal caps 29 which are also secured to the envelope's opposing ends in the manner shown. As illustrated, pins 21 project externally from these metal end caps. Both pins 21 and caps 29 are metallic, and may be produced from materials known in the art.

In accordance with the teachings of this invention, there is provided first and second magnetic field generating means 31 and 31' respectively, each of which is located so as to substantially surround a respective electrode in order to apply a static magnetic field across this electrode such that the maximum field strength so generated is substantially located at the electrode's filament. Th result is an increase in efficacy on the scale of about one percent. As shown in FIG. 1, the first magnetic field generating means 31 is located on an external surface of envelope 11 so as to substantially surround the corresponding filament 19 of first electrode 15. It is understood that the second magnetic field generating means 31' is similar to means 31, including the positioning relationship thereof relative to electrode 15'. In a preferred embodiment, means 31 and 31' are each permanent magnets which are of cylindrical configuration and are slidably positioned on envelope 11 to the orientation shown. In one example, ring magnets manufactured by Indiana General Magnetic Products (a division of Electronic Memories & Magnetics Corp.) and available from Permag Northeast Corp., 10 Fortune Drive, Billerica, MA 01865, were successfully utilized, said magnets sold under the stock number CG-707. Each magnet was produced from a nickel-aluminum-cobalt alloy, ALNICO 5. Each of these magnets was retained in position using a pair of retention members 35, each of which was located on an opposite side of the positioned magnet. In a preferred embodiment, each of these retention members was a neoprene O-ring 37 which possessed an internal diameter slightly less than that of the envelope's outer diameter to assure a sound fit. Alternatively, each of the two permanent magnets may be fixedly secured to the envelope's external surface using a suitable adhesive (e.g., epoxy).

Figure 2:
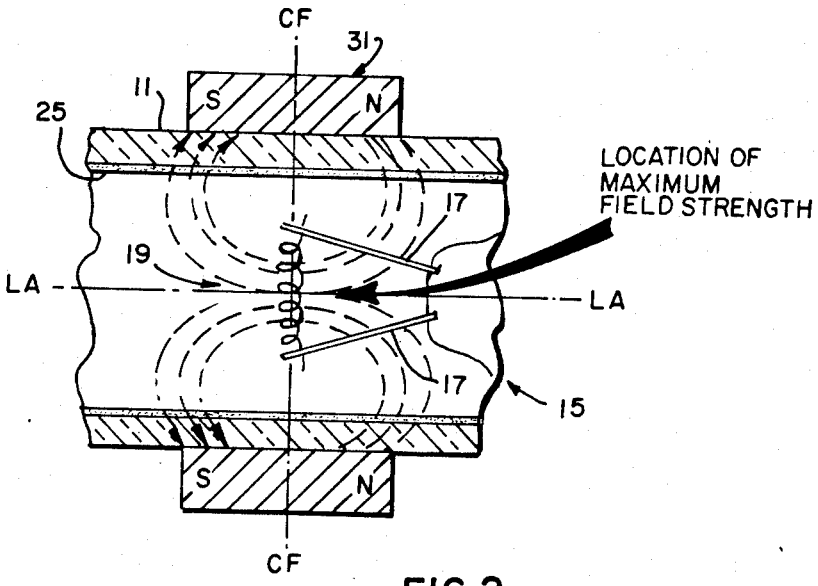
FIG. 2 is an enlarged partial, side elevational view, in section, depicting the location of one of the magnetic field generating means in accordance with a preferred embodiment of the invention relative to one of the invention's electrodes.

With attention to FIG. 2, there is shown an enlarged, partial view of one of the invention's magnetic field generating means (31) relative to the corresponding electrode structure located within the invention's envelope. The aforementioned neoprene O-rings are not illustrated for clarification purposes. Means 31, as stated, preferably comprises a permanent magnet. As shown in FIG. 2, this magnet is positioned such that its north (N) and south (S) poles are located on opposite faces thereof. Accordingly, the resulting magnetic field is generated in a substantially axial direction along the longitudinal axis (LA—LA) at the center of the tubular, elongated envelope 11. These flux lines are represented by the dashed lines in FIG. 2. Significantly, the location of maximum field strength produced by the invention's generating means is substantially located at the center of filament 19, said filament being oriented within envelope 11 such that the central axis thereof (CF—CF) lies orthogonal to the corresponding longitudinal axis of the envelope. This unique orientation and application of magnetic flux has proven to provide the described increase in lamp efficacy.

We believe the application of the magnetic field in the electrode region causes a spiraling action on the primary electrons and prevents them from being lost to the walls thereby resulting in a more efficient excitation process.

EXAMPLE

A linear fluorescent lamp having a cylindrical envelope with an outer diameter of 1.50 inch and an overall length of about 48 inches was produced using the teachings herein. The two magnets utilized were those mentioned above and obtained from the Permag Northeast Corp. The lamp was seasoned (operated) for about 1700 hours at a constant power of 40 watts. A phosphor having a chemical composition consisting of calcium halophosphate, antimony and manganese was utilized. This phosphor possessed a peak wave length of 582 nanometers (nm), an excitation peak of about 256 nm, and standard decay time of $6.0\times10^{-3}$ seconds. Such a phosphor is known in the art and represents but one example of several such materials which could be successfully utilized with this invention. In comparison to a control lamp (a similar envelope having aluminized teflon rings thereon) the voltage applied to the invention decreased by 2.6 percent while the electrical current increased about 3.3 percent. Because the testing was performed utilizing a standard integrating sphere, each of the permanent magnets was coated with reflecting aluminum foil. An efficacy increase of 0.96 percent was observed over the control lamp. Each of the magnets produced a field strength of 250 Gauss at the center of the lamp.

Thus there has been shown and described a fluorescent lamp wherein the efficacy thereof is increased using a relative facile and inexpensive means. Such a means is adaptable to both current production as well as to existing lamps presently in operation.

While there have been shown and described what are at present considered the preferred embodiments of the present invention, it will be obvious to those skilled in the art that various changes and modifications may be made therein without departing from the scope of the invention as defined by the appended claims. For example, it is within the scope of the invention to utilize other magnetic field generating means than permanent magnets as described. For example, electromagnetic coils could be positioned about the envelope's external surface. Alternatively, relatively thin magnetic films could be utilized, said films also applied to the envelope's external surface in the vicinity of the respective electrode structures. It is even further within the scope of the invention to position such magnetic field generating means internally of the lamp envelope with relatively minor modification thereto.

What is claimed is:

1. In a fluorescent lamp including an elongated tubular envelope having first and second opposing end portions an including therein an atmosphere of mercury and a rare gas, and first and second electrodes disposed within said first and second opposing end portions, respectively, each of said electrodes including a pair of lead wires and a filament, the improvement comprising:

first and second magnetic field generating means substantially surrounding said first and second electrodes, respectively, each of said magnetic field generating means applying a static magnetic field across said respective electrode and in a substantially axial pattern along the longitudinal axis of said elongated tubular envelope such that the maximum field strength of said field is substantially located at said filament thereof, whereby the efficacy of said fluorescent lamp is increased.

2. The improvement according to claim 1 wherein each of said magnetic field generating means is a permanent magnet positioned about the external surface of said envelope.

3. The improvement according to claim 2 wherein each of said permanent magnets is slidably positioned on said envelope, said lamp further including first and second pairs of retention members, each of said pairs of retention members being positioned on opposite sides of a respective one of said permanent magnets for retaining said magnets in position of said envelope.

4. The improvement according to claim 3 wherein each of said retention members is an O-ring.

5. The improvement according to claim 2 wherein each of said permanent magnets is fixedly secured to said external surface of said envelope.

6. The improvement according to claim 5 wherein each of said permanent magnets is secured to said external surface of said envelope by epoxy.

7. The improvement according to claim 1 wherein each of said filaments is a coiled filament and is positioned within said envelope substantially orthogonal to said longitudinal axis of said elongated tubular envelope.

8. The improvement according to claim 1 wherein said elongated tubular envelope is of substantially linear configuration.

* * * * *